US009194118B2

(12) United States Patent
Spyrou

(10) Patent No.: US 9,194,118 B2
(45) **Date of Patent: *Nov. 24, 2015**

(54) BRICK BRACKET FOR INSTALLATION OF A LEDGER ON THE BRICK FACING OR VENEER OF A STRUCTURE AND ASSOCIATED METHODS FOR THE INSTALLATION OF THE BRICK BRACKET ON THE BRICK FACING

(71) Applicant: Alexis Spyrou, Port Jefferson, NY (US)

(72) Inventor: Alexis Spyrou, Port Jefferson, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/087,824

(22) Filed: Nov. 22, 2013

(65) Prior Publication Data

US 2015/0135630 A1 May 21, 2015

Related U.S. Application Data

(63) Continuation of application No. 12/792,358, filed on Jun. 2, 2010, now Pat. No. 8,621,802.

(60) Provisional application No. 61/183,740, filed on Jun. 3, 2009.

(51) Int. Cl.

| | |
|---|---|
| ***E04B 1/38*** | (2006.01) |
| ***E04B 2/30*** | (2006.01) |
| ***E04B 1/41*** | (2006.01) |
| ***E04B 1/00*** | (2006.01) |
| ***E04B 2/56*** | (2006.01) |
| ***E04F 13/14*** | (2006.01) |

(52) U.S. Cl.

CPC . *E04B 1/40* (2013.01); *E04B 1/003* (2013.01); *E04B 2/56* (2013.01); *E04F 13/142* (2013.01); *E04B 2001/405* (2013.01); *E04B 2002/565* (2013.01)

(58) Field of Classification Search

CPC ..... E04B 1/38; E04B 2/30; E04B 1/40; E04B 2/56; E04B 1/003; E04B 2001/405; E04B 2002/565; E04F 13/142

USPC ..... 52/489.1, 705, 712, 713, 714, 745.21, 52/169.5, 378, 379; 248/216.1, 216.4, 248/218.3

See application file for complete search history.

(56) References Cited

U.S. PATENT DOCUMENTS

| | | | | | |
|---|---|---|---|---|---|
| 1,920,520 | A | * | 8/1933 | Nord | 248/48.2 |
| 3,471,988 | A | * | 10/1969 | Allen | 52/714 |
| 3,494,090 | A | * | 2/1970 | Allen | 52/713 |
| 3,729,882 | A | * | 5/1973 | Allen | 52/300 |
| 3,782,058 | A | * | 1/1974 | Allen | 52/300 |
| D246,573 | S | * | 12/1977 | White | D8/384 |
| 4,711,593 | A | * | 12/1987 | Wilhelmi | 403/187 |
| 4,765,111 | A | * | 8/1988 | Osawa | 52/509 |
| 4,837,991 | A | * | 6/1989 | Shaw | 52/98 |
| 5,170,977 | A | * | 12/1992 | McMillan | 248/300 |
| 5,501,050 | A | * | 3/1996 | Ruel | 52/513 |
| 5,890,334 | A | * | 4/1999 | Hughes, Jr. | 52/299 |
| 6,463,710 | B1 | * | 10/2002 | Barnhart | 52/698 |

(Continued)

*Primary Examiner* — Rodney Mintz

(74) *Attorney, Agent, or Firm* — Sorell, Lenna & Schmidt, LLP

(57) ABSTRACT

A brick bracket which is installed in a recess provided by removal of brick of a brick veneer in order to be attached to studs of a framework of the building without contacting the bricks. The brick bracket has a front wall which extends outwardly and covers the brick facing and carries carriage bolts to which a ledger can be affixed such that the ledger is able to support an attached structure so that the brick bracket will not apply any force to the bricks of the brick facing.

19 Claims, 3 Drawing Sheets

(56) References Cited

U.S. PATENT DOCUMENTS

| | | | | |
|---|---|---|---|---|
| 7,856,776 | B2 * | 12/2010 | Van Der Lee | 52/235 |
| 8,443,569 | B2 * | 5/2013 | Sias | 52/715 |
| 8,621,802 | B2 * | 1/2014 | Spyrou | 52/378 |
| 8,826,620 | B2 * | 9/2014 | Krause | 52/506.08 |
| 8,833,025 | B2 * | 9/2014 | Krause | 52/506.08 |
| 9,045,892 | B2 * | 6/2015 | Smith et al. | 1/1 |
| 2002/0062616 | A1 * | 5/2002 | Ocampo | 52/656.9 |
| 2006/0016138 | A1 * | 1/2006 | Blount | 52/263 |
| 2006/0101760 | A1 * | 5/2006 | Cahoon | 52/459 |
| 2010/0024331 | A1 * | 2/2010 | Stiffler et al. | 52/236.8 |
| 2010/0307094 | A1 * | 12/2010 | Spyrou | 52/489.1 |
| 2012/0167505 | A1 * | 7/2012 | Krause | 52/302.1 |
| 2013/0074429 | A1 * | 3/2013 | Lehtinen et al. | 52/182 |
| 2013/0152498 | A1 * | 6/2013 | Krause | 52/235 |
| 2014/0215956 | A1 * | 8/2014 | Smith et al. | 52/705 |
| 2015/0059259 | A1 * | 3/2015 | Hatzinikolas | 52/98 |

* cited by examiner

BRICK BRACKET FOR INSTALLATION OF A LEDGER ON THE BRICK FACING OR VENEER OF A STRUCTURE AND ASSOCIATED METHODS FOR THE INSTALLATION OF THE BRICK BRACKET ON THE BRICK FACING

CROSS RELATED APPLICATION

This application is a continuation of U.S. patent application Ser. No. 12/792,358, filed on Jun. 2, 2010, which claims the benefit of U.S. Provisional Application Ser. No. 61/183,740 filed Jun. 3, 2009 and claims the priority thereof. Each of the above-identified applications being incorporated herein by reference in their respective entirety.

FIELD OF THE INVENTION

The invention relates to a bracket referred to as a brick bracket for the installation of a ledger at the surface of a brick facing or veneer of a structure such as a building.

The invention also relates to a method for the installation of such a brick bracket.

BACKGROUND

A problem exists as regards how to connect a load bearing member to a building having a brick facing or veneer. Most Building Codes specify that brick veneer can only support its own weight and cannot support additional loads, such as those from an outside structure such as a deck or roof system.

This presents a problem when it is desired to build a deck on a house with a brick veneer as it is necessary to support a ledger at the side of the house, that serves to support the joists of the deck and resists the weight of the deck. Since the ledger cannot be attached to the brick of the veneer other measures need to be taken.

Normally, the bricks must be removed in the area of the ledger and supported from above which is a difficult and expensive process.

In such case, the ledger is attached to the existing framework of the house with very long bolts of sufficient strength that can resist the bending forces induced in them as the bolts project outwardly from the framework four to five inches. Furthermore this can still lead to application of load on the bricks of the brick veneer because the bolts deflect under the load.

In the case of a deck it can be built free standing with additional girders and posts on footings. This is costly and also lacks attachment of the deck to the building.

All of these solutions create additional engineering material and labor costs and are difficult to implement.

SUMMARY OF THE INVENTION

An object of the invention is to provide means by which the deck can be connected to the framework of the building in a simple manner without the need for incident costs and labor as described above.

A further object of the invention is to provide such means by which the ledger can be attached to the framework without risk of applying forces to the brick veneer.

In accordance with the invention a bracket is provided which enables the ledger to be connected to the framework of the building without applying a load from the ledger to the bricks of the brick veneer.

In further accordance with the invention a plurality of brick brackets are installed on studs of the framework of the building, usually spaced at 16 inches. The brick brackets can be installed on each stud or on spaced studs depending on the size and weight of the deck. At each brick bracket location, three bricks are removed, namely two bricks in each row and one brick in the row thereabove. This is easily done and involves minimum labor and without any additional shoring. The brick bracket is formed with a rear wall serving as a back plate and the bracket is inserted into the recess formed by the removal of the bricks until the back wall fits flush against the respective stud for the sheathing thereon, (if any) and is fixed thereto by a plurality of lag bolts. A spanning plate extends forwardly from the back plate wall over the top surface of the next lower row of bricks by a spacing thereof so that no contact is made by the spanning plate and the bricks of the next lower row. A front wall or support plate depends from the spanning plate outside the surface of the brick veneer. The front wall supports a ledger, usually of wood. The ledger extends along the length of the brackets and is secured thereto by carriage bolts. The three bricks can be reinstalled or alternatively the space can be left open and subsequently covered by the deck joists and sealed by flags.

A feature of the invention is that the brick is rigid and made of metal in order to resist deflection.

In further accordance with the invention the bracket serves as a means to apply the load from the deck to the framework of the building without application of any force to the underlying bricks.

The method of the invention is very simple and requires no complexity in the installation of the brackets to the framing and it also assures that no bending forces will be applied to the underlying bricks of the brick veneer due to the weight of the deck and the use to which it is put.

Although the invention is described with respect to installation of a deck, the invention is also applicable to the attachment of numerous other structure or equipment.

DETAILED DESCRIPTION OF THE EMBODIMENTS OF THE INVENTION

Figure 1:
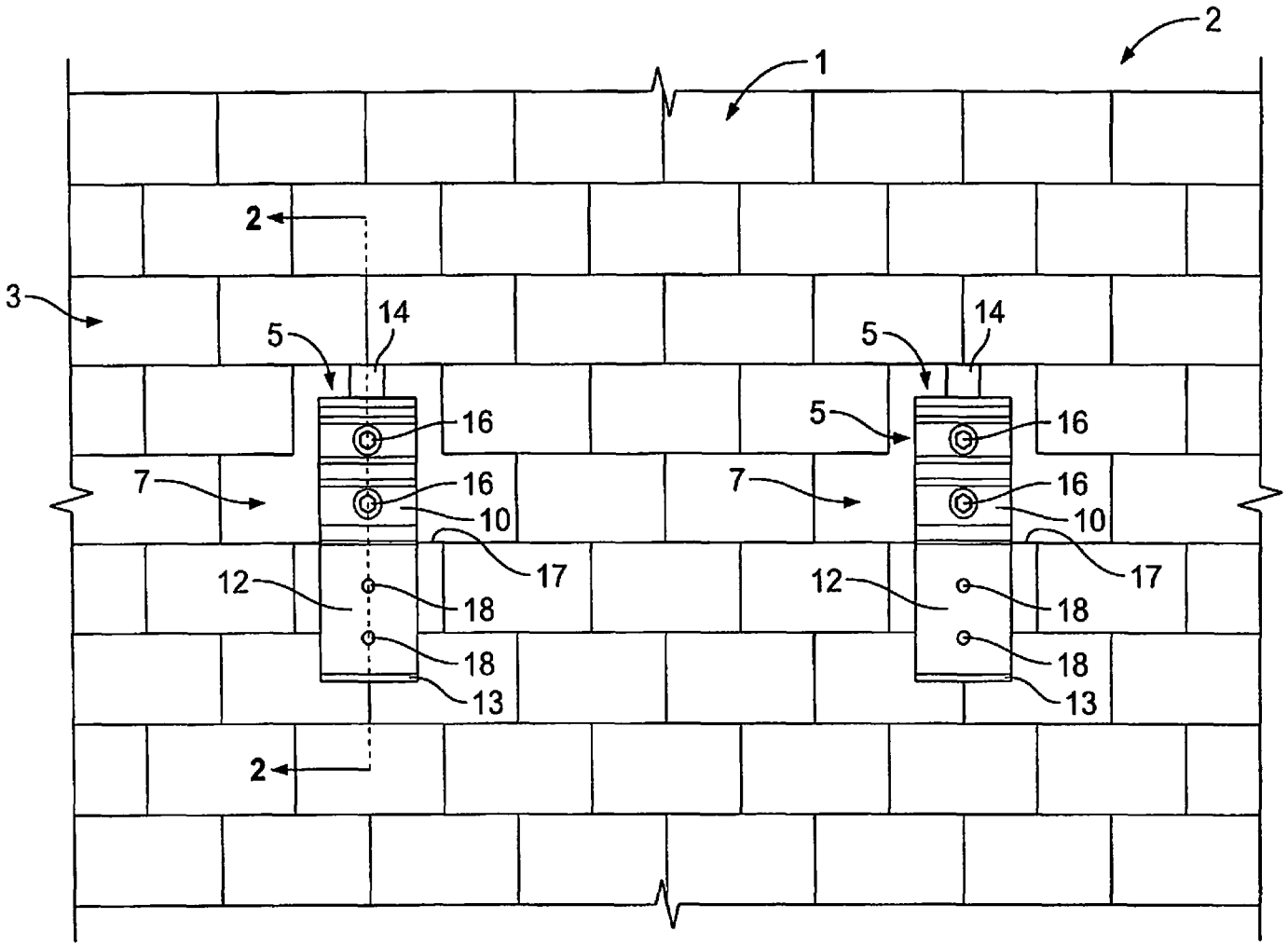
FIG. 1 is a front view of a portion of a building having a brick veneer to which is installed a brick bracket according to the invention.

FIG. 1 shows a portion of a wall 1 of a building 2 such as a house. The wall 1 has a brick facing or veneer 3 composed of rows of bricks 4 placed one above the other.

The invention is based on a construction by which a structure such as a deck (not shown) can be attached to a building. Although the invention will be described in relation to the attachment of a deck to the building it is only by way of example and other structures can be attached within the contemplation of the invention.

Since numerous Building Codes prohibit the application of load to the brick facing or veneers of the building 1 to the invention provides a unique way in which the deck can be attached to the building without imposing any load upon the brick facing. In this regard, the invention provides a plurality of brackets 5 spaced longitudinally along the line of bricks attached to the building and adapted to support the ledger 6 which extends along the length of the building over a distance corresponding to the width of the deck. The ledger 6 is intended to support the ends of joists of the deck whose opposite ends are supported at a distance from the building corresponding to the length of the deck. The manner of support of these opposite ends is not shown and is well known in the art. It should be noted that the deck can be placed at ground level or at an elevation, for example, where a door can be opened to lead to the deck. Since the brackets 5 are associated with the bricks of the brick facing they will be referred to at various times as brick brackets.

In order to attach the brackets 5 to the building 2, three bricks are removed two in one line of bricks and one in the next higher row centrally located above the two bricks in order to provide a void or recess 7 in the brick facing 3. The removal of the bricks 4 is easily carried out and requires no special skill or implements. The brick bracket 5 is then inserted within the recess 7.

The brick bracket 5 comprises a back plate or wall 10 forming an attachment wall from which a spanning plate or wall 11 extends forwardly substantially perpendicular to the back plate. At the remote end of the spanning plate 11, a front plate 12 or wall depends substantially perpendicular to the spanning plate 11 the lower end of the front plate, a ledge 13 extends substantially perpendicular thereto.

The brick bracket 5 is inserted into the recess 7 so that the back wall 10 of the brick bracket abuts against sheathing (not shown) of a stud 14 of the framing 15 of the building. Since it is intended that the brick brackets 5 are to be secured to the studs 14, the brackets are spaced along the wall of the building at intervals corresponding to the spacing of the studs 14. Normally this is 16" and the brackets 6 can be secured at 16" spacing for relatively large and heavy decks, whereas for smaller and lighter decks the spacing can be at 32" or any other multiple of 16". The back wall 10 of each bracket extends over a height so that its top edge is spaced below the lower surface of the next higher row of bricks while its lower edge extends below the next lower row of bricks in order to fit into the space between the next lower row of bricks and the stud 14. The back wall is secured to the stud 14 by lag bolts 16 to be fixed thereto. The back wall is fixed to the stud 14 at such a height so that the spanning wall 11 extends a distance d above the top surface 17 of the fixed lower brick. The distance is generally equal to the thickness of the mortar placed between superimposed bricks. A layer of closed cell foam 19 can be introduced to fill this space and provide no transmission of force between the brick bracket and the top surface 17. By spacing the spanning plate 11 above the top surface 17 of the next lower row of bricks, transmission of any force from the spanning plate 11 and thereby of the brick brackets to the bricks is avoided.

Figure 2:
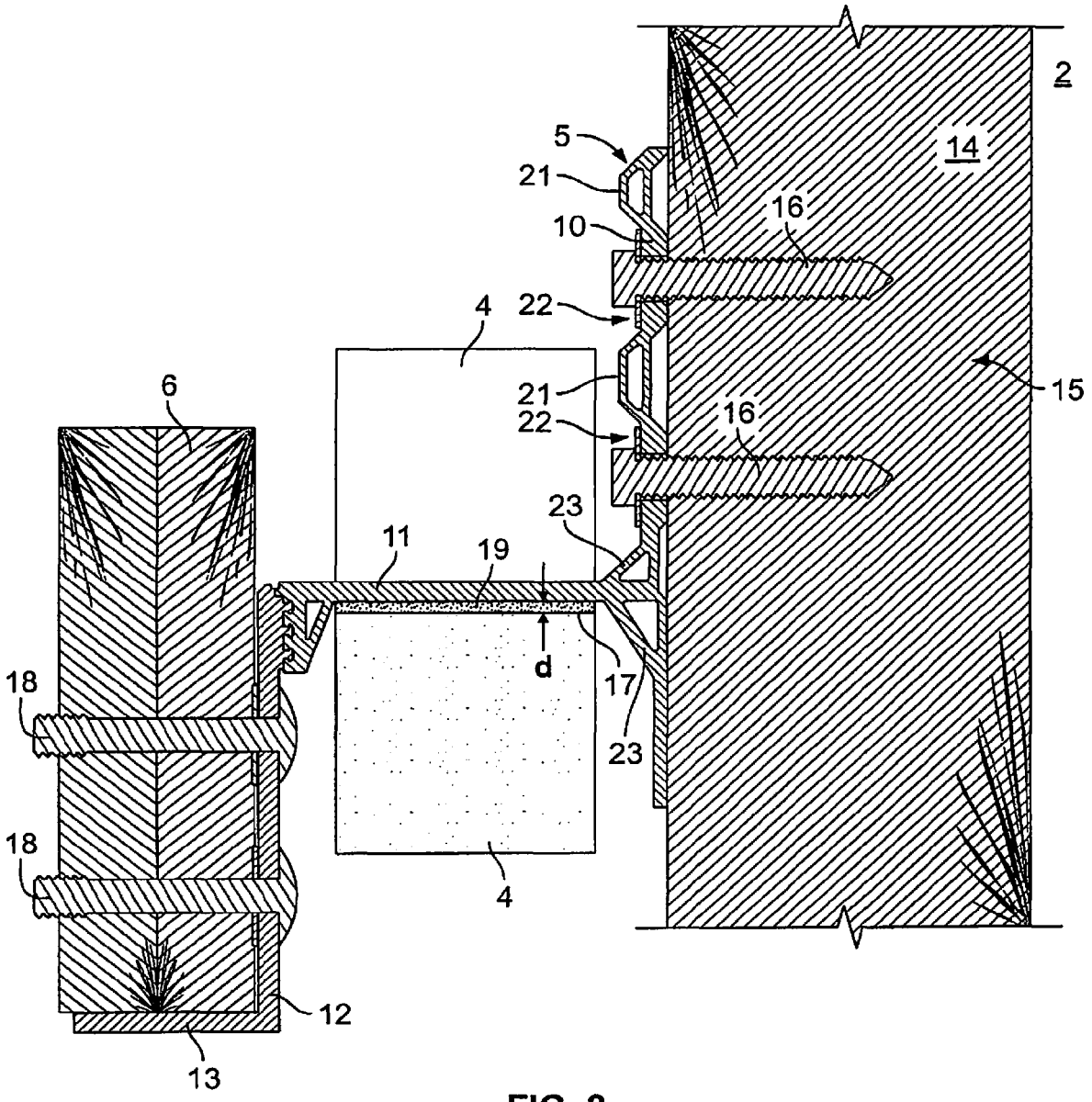
FIG. 2 is a sectional view taken along line 2-2 in FIG. 1.
Figure 3:
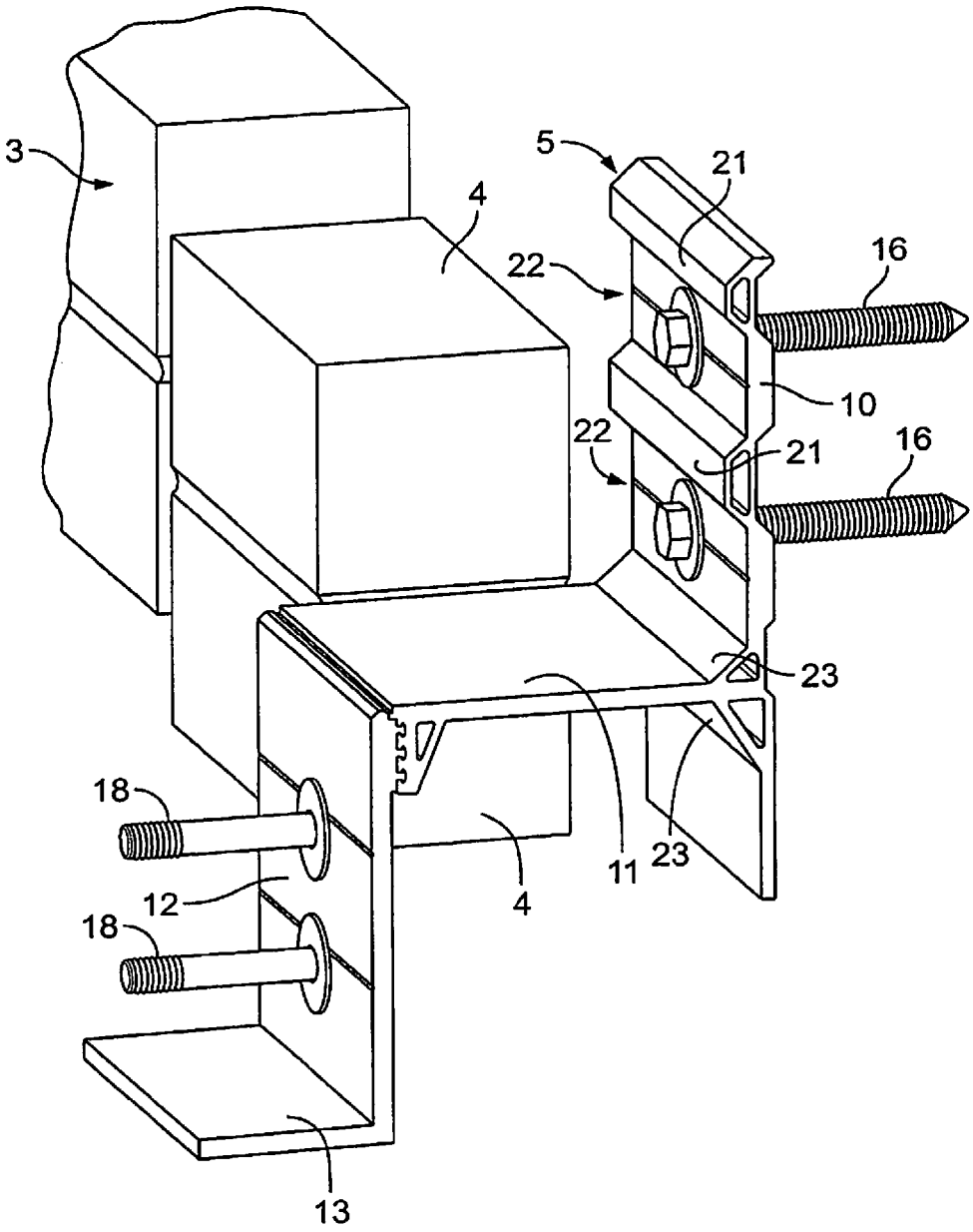
FIG. 3 is a perspective view from the front and right side of FIG. 2.

The front plate 12 extends downwardly from the spanning plate 11 over the next lower row of bricks and beyond and the ledge 13 extends forwardly from the front wall. The pair of carriage bolts 18 have been fixedly installed in the front plate and extend outwardly therefrom as shown in FIG. 2. The ledger 6 is installed on the carriage bolts and affixed thereto by nuts (not shown). The ledge can serve as a support means for the ledger in the course of its installation on the carriage bolts.

The bricks that have been removed from the brick facing can now be reinstalled in the recess 7 and mortar can be filled in the space between the adjoining bricks except for the lower surface which adjoins the upper surface 17 of the next lower row of bricks. Alternatively, the space can be left open without reinsertion of the removed bricks as the ledger will cover this space. In such case, sealing can be carried out between the ledger and the brick facing.

The ledger is of a size to accommodate the joists of the deck and in general will vary between 2×6 and 2×10. The ends of the joist rest on the top of the ledger and are secured thereto by conventional means, such as nails, bolts, and cleats.

The brick bracket is made substantially rigid to avoid bending and deflection and its thickness is a function of the size of the deck. In general the brick bracket will have a thickness between 3/16" and 3/8". The brick brackets are made of metal and in particular aluminum as these are light weight and strong.

The brick bracket 5 is preferably made as an extrusion. Specifically, in a preferred embodiment, the back wall 10 and the spanning wall 11 are made as one extrusion of T shape, and the front wall 12 and ledge 13 are made as a second extrusion of L-shape. The facing ends of walls 11 and 12 are formed with an interlocking joint, such as a tongue and groove, and are engaged and welded together to form the bracket.

The back plate 10 is formed with ridges (not shown) of triangular cross-section that extend thereacross to form a "washbasin-like" effect to provide strength and facilitate installation on the studs.

In order to install the lag bolts 16 and small recesses (not shown) are provided in the respective plates to facilitate such installation.

The back plate 10 is formed with projections 21 and its front face of trapezoidal cross section that extend thereacross provide strength and facilitate installation on the studs. To this effect the projections are interrupted to form recesses 22 into which the lag bolts 16 are inserted. At the lower end of plate 10 a triangular brace 23 is formed to join the back plate 10 with the spanning plate 11.

Although the invention has been described in relation to specific embodiments thereof it will become apparent to those skilled in the art that numerous modifications and variations thereof can be made without departing from the scope and spirit of the invention as defined in the attached claims.

What is claimed is:

1. A brick bracket comprising:

a first wall having a front face defining at least one cavity configured for disposal of a fastener, wherein the front face has at least one projection adjacent the at least one cavity;

a second wall disposed between a first brick and a second brick and having a first end connected to the first wall and a second end, the second wall including a first surface and a second surface oriented to face the second brick, the second surface spaced apart from the second brick to prevent a force applied to the brick bracket from being transmitted to the second brick; and a third wall connected to the second wall and including a first surface extending transversely to engage a support member and a second surface extending along at least a portion of the second brick, the second surface of the third wall is oriented to face the second brick and spaced apart from the second brick.

2. The brick bracket as recited in claim 1, wherein the first end of the second wall is attached to the first wall via interlocking components.

3. The brick bracket as recited in claim 1, wherein the at least one projection has a trapezoidal cross-section.

4. The brick bracket as recited in claim 1, wherein the front face of the first wall defines a plurality of projections, the projections being interrupted to form the at least one cavity.

5. The brick bracket as recited in claim 1, wherein the first surface of the second wall is oriented to face the first brick.

6. The brick bracket as recited in claim 1, wherein a plurality of brick brackets are arranged in a spaced relation along a row of bricks.

7. The brick bracket as recited in claim 1, wherein a space between the second wall and the second brick is filled with a closed cell foam.

8. The brick bracket as recited in claim 1, wherein a triangular brace is configured to join the first wall with the second wall to provide support to the brick bracket.

9. The brick bracket as recited in claim 1, wherein the brick bracket is formed as an extrusion.

10. The brick bracket as recited in claim 1, wherein the brick bracket is rigid.

11. The brick bracket as recited in claim 1, wherein the at least one cavity includes a recess.

12. The brick bracket as recited in claim 11, wherein the recess is configured for disposal of a lag bolt.

13. The brick bracket as recited in claim 1, wherein the first wall is configured for attachment to a stud within a framework.

14. The brick bracket as recited in claim 13, wherein the first wall is fixed to the stud at a height such that the second wall is spaced apart a distance from a fixed lower brick.

15. A brick bracket comprising:

a back wall configured for attachment to a stud having a front face defining a plurality of projections that define at least one cavity therebetween configured for disposal of a lag bolt;

a spanning wall extending perpendicular to the back wall and being disposed between a first brick and a second brick, the spanning wall having a first end attached to the back wall via interlocking components and a second end, the spanning wall including a first surface oriented to face the first brick and a second surface oriented to face the second brick, the second surface being spaced from the second brick to prevent a force applied to the brick bracket from being transmitted to the second brick; and a front wall connected to the spanning wall and including a first surface extending transversely to engage a ledger and a second surface extending along at least a portion of the second brick, the second surface of the front wall is oriented to face the second brick and spaced apart from the second brick.

16. A brick bracket system comprising:

at least one brick bracket including:

a first wall having a front face defining at least one cavity;

a second wall disposed between a first brick and a second brick and having a first end connected to the first wall and a second end, the second wall including a first surface and a second surface oriented to face the second brick, the second surface spaced apart from the second brick to prevent a force applied to the brick bracket from being transmitted to the second brick, and a third wall connected to the second wall and including a first surface extending transversely to engage a ledger and a second surface extending along at least a portion of the second brick, the second surface of the third wall is oriented to face the second brick and spaced apart from the second brick;

at least one lag bolt configured for disposal with the at least one cavity and connection to a stud; and a fastener configured to connect the ledger with the first surface of the third wall.

17. The brick bracket system as recited in claim 16, wherein the brick bracket is formed as an extrusion.

18. The brick bracket system as recited in claim 16, wherein the first wall is fixed to the stud at a height such that the second wall is spaced apart a distance from a fixed lower brick.

19. The brick bracket system as recited in claim 18, wherein the space between the second wall and the fixed lower brick is filled with a closed cell foam.

* * * * *